US011674520B2

(12) United States Patent
Takeishi et al.

(10) Patent No.: US 11,674,520 B2
(45) Date of Patent: Jun. 13, 2023

(54) CENTRIFUGAL FAN AND AIR-CONDITIONING APPARATUS

(71) Applicant: Mitsubishi Electric Corporation, Tokyo (JP)

(72) Inventors: Keisuke Takeishi, Tokyo (JP); Makoto Tanishima, Tokyo (JP); Tomoya Fukui, Tokyo (JP); Hiroki Fukuoka, Tokyo (JP); Makoto Kurihara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/287,125

(22) PCT Filed: Dec. 13, 2018

(86) PCT No.: PCT/JP2018/045896
§ 371 (c)(1),
(2) Date: Apr. 21, 2021

(87) PCT Pub. No.: WO2020/121484
PCT Pub. Date: Jun. 18, 2020

(65) Prior Publication Data

US 2021/0381513 A1 Dec. 9, 2021

(51) Int. Cl.
*F04D 17/10* (2006.01)
*F04D 29/28* (2006.01)
(Continued)

(52) U.S. Cl.
CPC ..... *F04D 17/10* (2013.01); *F04D 29/281* (2013.01); *F04D 29/584* (2013.01)

(58) Field of Classification Search
CPC ..... F04D 17/10; F04D 29/384; F04D 29/30; F04D 29/281; F04D 25/08; F04D 19/002;
(Continued)

(56) References Cited

U.S. PATENT DOCUMENTS 6,908,287 B2 * 6/2005 Cho ..... F04D 29/384 416/189
7,121,807 B2 * 10/2006 Cho ..... F04D 29/384 416/DIG. 2
(Continued)

FOREIGN PATENT DOCUMENTS

JP 50-157735 U 12/1975
JP 2001-140789 A 5/2001
(Continued)

OTHER PUBLICATIONS

International Search Report and Written Opinion dated Feb. 26, 2019, received for PCT Application No. PCT/JP2018/045896, Filed on Dec. 13, 2018, 10 pages including English Translation.
(Continued)

*Primary Examiner* — Eric J Zamora Alvarez
(74) *Attorney, Agent, or Firm* — Xsensus LLP

(57) ABSTRACT

A centrifugal fan includes a main plate, a blade connected to the main plate, and a shroud having an annular shape and connected to a shroud-side end of the blade that is an end opposite a main-plate-side end of the blade connected to the main plate. The centrifugal fan rotates about a rotation axis to suction a fluid through an opening of the shroud and discharge the fluid through the blade in a radial direction. A leading edge of the blade includes a recess located next to a point at which a shroud inner surface of the shroud that faces the main plate is connected to the leading edge and curving inwardly from the point toward a trailing edge and a projection located closer to the main plate than is the recess and projecting in the rotation direction.

11 Claims, 7 Drawing Sheets

(51) Int. Cl.
*F04D 29/58* (2006.01)
*F04D 29/30* (2006.01)
*F24F 1/0022* (2019.01)

(58) Field of Classification Search
CPC .... F04D 25/088; F04D 29/282; F04D 29/326; F04D 29/388; F04D 29/328; F04D 29/544; F04D 29/584; F05D 2240/304; F05D 2240/301; F05D 2250/182; F05D 2250/183; F05D 2240/303; F05D 2250/184; F05D 2250/181; F05D 2250/70; F05D 2250/712; F24F 1/0022
See application file for complete search history.

(56) References Cited

U.S. PATENT DOCUMENTS

| | | | |
|---|---|---|---|
| 2016/0245298 | A1 | 8/2016 | Ohtaguro |
| 2017/0275997 | A1 | 9/2017 | Nakashima et al. |

FOREIGN PATENT DOCUMENTS

| | | | |
|---|---|---|---|
| JP | 2005-233057 | A | 9/2005 |
| JP | 2009-74385 | A | 4/2009 |
| JP | 2010-53803 | A | 3/2010 |
| JP | 2012-85836 | A | 5/2012 |
| JP | 2015-68310 | A | 4/2015 |
| JP | 2016-121580 | A | 7/2016 |
| JP | 2019-127865 | A | 8/2019 |
| WO | 2016/067409 | A1 | 5/2016 |

OTHER PUBLICATIONS

Notice of Reasons for Refusal received for Japanese Patent Application No. 2019-537187, dated Sep. 3, 2019, 14 pages including English Translation.
Notice of Reasons for Refusal received for Japanese Patent Application No. 2019-537187, dated Jan. 7, 2020, 7 pages including English Translation.

* cited by examiner

CENTRIFUGAL FAN AND AIR-CONDITIONING APPARATUS

CROSS-REFERENCE TO RELATED APPLICATIONS

The present application is based on PCT filing PCT/JP2018/045896, filed Dec. 13, 2018, the entire content of which is incorporated herein by reference.

TECHNICAL FIELD

The present disclosure relates to a centrifugal fan and an air-conditioning apparatus including the centrifugal fan, and in particular, relates to the shape of blades of the centrifugal fan.

BACKGROUND ART

Some centrifugal fans such as a centrifugal fan disclosed in Patent Literature 1 are used to send a gas such as air or a liquid such as water and refrigerant. The centrifugal fans each include a plurality of blades arranged in a circumferential direction and a disc-shaped or cup-shaped hub disposed at first ends of the blades in an axial direction. Some centrifugal fan includes an annular shroud disposed at second ends of the blades opposite from the hub. In an air-conditioning apparatus including, as an air-sending device, a centrifugal fan, the centrifugal fan is rotated by a motor, a fluid is suctioned into the air-conditioning apparatus through an air inlet, the fluid is guided to a shroud of the centrifugal fan along an inner circumferential surface of a bell mouth, and the fluid is then discharged radially through a plurality of blades arranged circumferentially about the axis of rotation of the centrifugal fan.

Part of the fluid radially discharged through the blades passes through a space between an outer circumferential surface of the shroud and a casing, passes through a space between an outer circumferential surface of the bell mouth and an inner circumferential surface of the shroud, and is then guided to the shroud of the centrifugal fan. Hereinafter, this flow is referred to as a circulating flow. Air that is radially discharged through the blades of the centrifugal fan and is not included in the circulating flow passes through a heat exchanger of the air-conditioning apparatus and is then discharged to the outside of the air-conditioning apparatus. The above-described circulating flow moves at high velocity when passing through the space between the outer circumferential surface of the bell mouth and the inner circumferential surface of the shroud. For this reason, collision of the circulating flow passing past the inner circumferential surface of the shroud with leading edges of the blades of the centrifugal fan increases noise from the centrifugal fan and causes flow separation of the fluid in a region adjacent to the shroud, or a shroud-side region, on a suction surface of the leading edge of each blade. In particular, at a position where trailing edges of the blades located at the outside diameter of the centrifugal fan are located closest to the heat exchanger of the air-conditioning apparatus, the air flow separation in the shroud-side region on the suction surface of each leading edge extends a stall zone toward the trailing edge. Consequently, the stall zone is widely extended from the leading edge to the trailing edge in the shroud-side region on the suction surface of each blade, and a significant reduction in efficiency of the centrifugal fan is thus caused.

For such a centrifugal fan, the shape of each blade is changed to achieve efficiency improvement and noise reduction.

CITATION LIST

Patent Literature

Patent Literature 1: Japanese Unexamined Patent Application Publication No. 2015-068310

SUMMARY OF INVENTION

Technical Problem

A high-velocity circulating flow enters a centrifugal fan through a space defined between a shroud and a bell mouth of the centrifugal fan. The circulating flow flows along an inner surface of the shroud to blades. In a structure disclosed in Patent Literature 1, a blade angle distribution in which the blade angle is constant or decreases along a camber line is provided to reduce noise caused by a circulating flow. Disadvantageously, this structure has a small effect of reducing flow separation at the leading edge of each blade. Specifically, in a centrifugal fan with such a structure, flow separation of a fluid is likely to occur in a shroud-side region on a suction surface of each blade, and the efficiency of the fan is thus reduced. In particular, in the centrifugal fan mounted in an air-conditioning apparatus such that the blades of the centrifugal fan are arranged at a short distance from a heat exchanger, large-scale flow separation occurs in the shroud-side region on the suction surface of each blade between the leading edge and the trailing edge of the blade. Disadvantageously, such large-scale flow separation significantly affects a reduction in efficiency of the centrifugal fan.

The present disclosure is intended to overcome the above-described disadvantages and aims to provide a centrifugal fan and an air-conditioning apparatus in which flow separation in a shroud-side region on a suction surface of a blade of the centrifugal fan is reduced to improve efficiency.

Solution to Problem

A centrifugal fan according to one embodiment of the present disclosure includes a main plate, a blade connected to the main plate, and a shroud having an annular shape and connected to a shroud-side end of the blade that is an end opposite a main-plate-side end of the blade connected to the main plate. The centrifugal fan is configured to rotate about a rotation axis to suction a fluid through an opening of the shroud and discharge the fluid through the blade in a radial direction. The blade has a leading edge that is an edge of the blade located forward in a rotation direction and a trailing edge that is an edge opposite the leading edge and is located farther from the rotation axis than is the leading edge. The leading edge includes a recess located next to a point P4 at which a shroud inner surface of the shroud that faces the main plate is connected to the leading edge and curving inwardly from the point P4 toward the trailing edge and a projection located closer to the main plate than is the recess and projecting in the rotation direction.

An air-conditioning apparatus according to another embodiment of the present disclosure includes a heat source unit and a load-side unit. At least one of the heat source unit and the load-side unit includes the above-described centrifugal fan.

Advantageous Effects of Invention

According to an embodiment of the present disclosure, reducing an angle formed by a tangent to the leading edge of the blade and a tangent to the shroud inner surface in the centrifugal fan reduces flow separation at the leading edge of the blade. Advantageously, the reduced flow separation results in a reduction in noise from the centrifugal fan and an increase in flow rate through the centrifugal fan to improve the efficiency of the fan. In the centrifugal fan mounted in the air-conditioning apparatus, if the blade of the centrifugal fan is located at a short distance from the heat exchanger such that a flow field on the suction surface may become unstable, flow separation at the leading edge of the blade is reduced, and a large-scale stall zone in a region between the leading edge and the trailing edge on the suction surface of the blade is thus eliminated. The eliminated large-scale stall zone results in noise reduction and a significant increase in flow rate to improve the efficiency of the fan.

DESCRIPTION OF EMBODIMENTS

Figure 1:
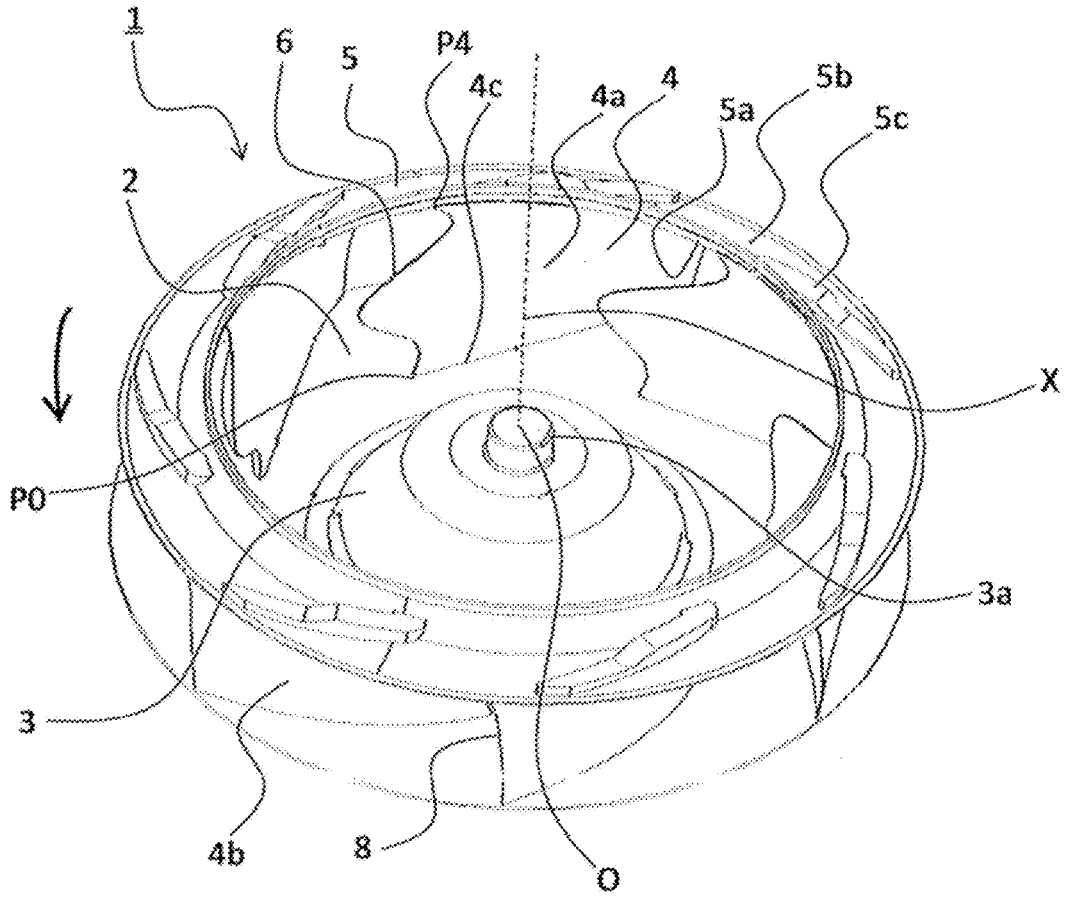
FIG. 1 is a perspective view of a centrifugal fan according to Embodiment 1.

Embodiments of a centrifugal fan and an air-conditioning apparatus including the centrifugal fan are described below. Note that the forms of components illustrated in the drawings are merely examples, and the present disclosure is not limited to the forms of components illustrated in the drawings. Furthermore, note that components designated by the same reference signs in the drawings are the same components or equivalents. This note applies to the entire description herein. Additionally, note that the forms of components described herein are merely examples and the present disclosure is not limited only to the description herein. In particular, a combination of components is not limited only to that in each embodiment. A component in one embodiment can be used in another embodiment. Furthermore, note that the relationship between the sizes of the components in the drawings may differ from that of actual ones.

Embodiment 1

FIG. 1 is a perspective view of a centrifugal fan 1 according to Embodiment 1. The centrifugal fan 1 includes a main plate 2, a plurality of blades 4 standing from the main plate 2, and a shroud 5 disposed such that the blades 4 are interposed between the main plate 2 and the shroud 5. The main plate 2 has a central hole through which a shaft extends and includes a cup-shaped hub 3 located around the hole and protruding from the main plate 2 toward the shroud 5. The blades 4 are arranged circumferentially around the hub 3. The shroud 5 is secured to ends of the blades 4 opposite from ends of the blades 4 to which the main plate 2 is secured. The shroud 5 has an annular shape. The central hole, to which the shaft connecting the centrifugal fan 1 to a power unit to rotate the centrifugal fan 1 is secured, of the main plate 2 is located at the center of rotation of the centrifugal fan 1.

Figure 2:
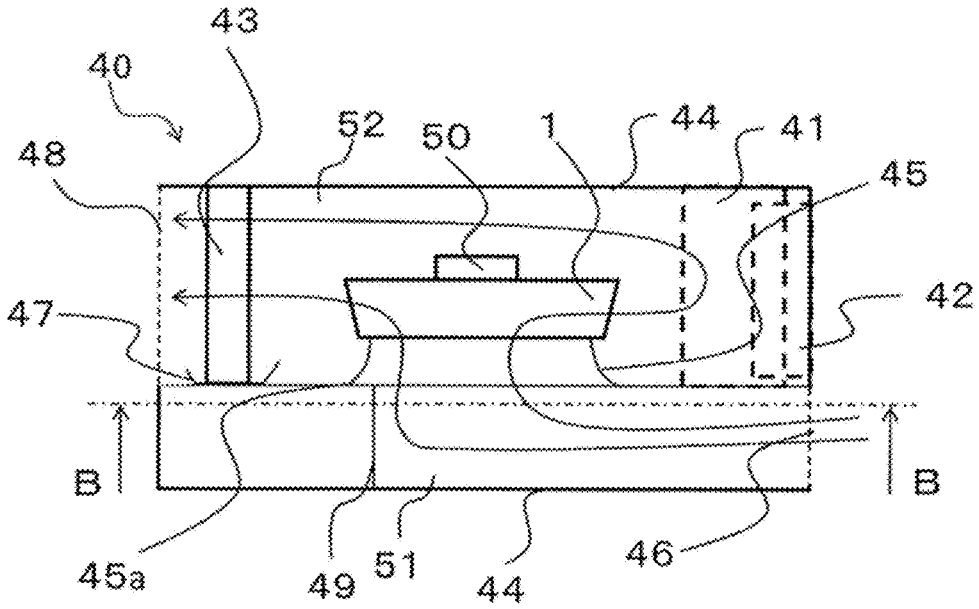
FIG. 2 is a sectional view illustrating the structure of a heat source unit including the centrifugal fan according to Embodiment 1.

FIG. 2 is a sectional view illustrating the structure of a heat source unit 40 including the centrifugal fan 1 according to Embodiment 1. FIG. 2 schematically illustrates the inside of the heat source unit 40. The centrifugal fan 1 is mounted in, for example, an air-conditioning apparatus or a heat source unit, and is used after the rotation shaft is secured to a rotor of a vehicle-mounted alternator or a rotary electric machine, such as a motor. In Embodiment 1, the centrifugal fan 1 mounted in the heat source unit 40 of an air-conditioning apparatus is described as an example. Although the centrifugal fan 1 mounted in the heat source unit 40 is described in Embodiment 1, the centrifugal fan 1 is not limited to this example. The centrifugal fan 1 may be mounted in another device, such as an air-conditioning-apparatus indoor unit and an air-sending device.

The heat source unit 40 is connected to a load-side unit, which is not illustrated, by refrigerant pipes to form a refrigeration cycle circuit. The air-conditioning apparatus circulates refrigerant through the refrigerant pipes in the refrigeration cycle circuit so that the load-side unit heats or cools an air-conditioned space. The air-conditioned space is a room of, for example, a house, a building, or a condominium. The heat source unit 40 is used as an outdoor unit of the air-conditioning apparatus. The load-side unit is used as an indoor unit of the air-conditioning apparatus.

The heat source unit 40 includes at least one heat exchanger 43, a compressor 41, a control box 42, the centrifugal fan 1, a bell mouth 45, a fan motor 50, and a drain pan 47 in a casing 44. The casing 44 is a shell of the heat source unit 40 and has an air inlet 46 and an air outlet 48.

The air inlet 46 and the air outlet 48 are opened in the casing 44 to provide communication between the inside and the outside of the casing 44. The air inlet 46 is opened in, for example, a rear wall of the casing 44. The air outlet 48 is opened in, for example, a front wall of the casing 44. In other words, the heat source unit 40 is configured such that air is suctioned into the heat source unit 40 from one side face of the casing 44 and the air is discharged from another side face of the casing 44.

Each side face of the casing 44 is divided into upper and lower panels, which are removable. In Embodiment 1, the lower panel of one side face is removed to provide an opening that defines the air inlet 46. Furthermore, the upper panel of another side face of the casing 44 is removed to provide an opening that defines the air outlet 48.

The heat exchanger 43 is disposed between the air outlet 48 and the centrifugal fan 1 and is disposed downstream of the centrifugal fan 1. The drain pan 47 is disposed under the heat exchanger 43 and receives, for example, condensation water that falls from the heat exchanger 43. The centrifugal fan 1 has a rotation axis X and rotates about the rotation axis X to send a fluid from the bell mouth 45 to the heat exchanger 43. The centrifugal fan 1 is connected at a center 0 to the fan motor 50 and is driven to rotate.

The bell mouth 45 is disposed at part of the centrifugal fan 1 through which a fluid is suctioned and guides the fluid flowing through an air inlet passage 51 to the centrifugal fan 1. The bell mouth 45 includes a portion having an opening that gradually decreases in diameter from its inlet adjacent to the air inlet passage 51 toward the centrifugal fan 1.

Figure 3:
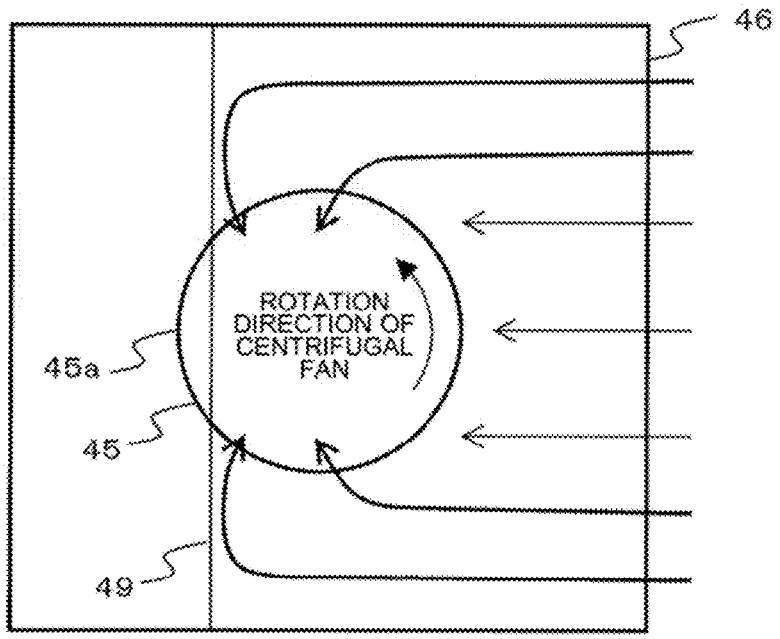
FIG. 3 is a schematic diagram schematically illustrating an example of a section taken along line B-B in FIG. 2.

FIG. 3 is a schematic diagram schematically illustrating an example of a section taken along line B-B in FIG. 2. The casing 44 has the air inlet passage 51 and an air outlet passage 52, which are divided by an air passage partition 49, in the casing 44. The air inlet passage 51 is defined between walls of the casing 44 and the air passage partition 49 facing the air inlet 46 and is located in lower part of the casing 44. The air inlet passage 51 communicates with the air inlet 46 and guides the air suctioned through the air inlet 46 to the bell mouth 45. The air outlet passage 52 is located in upper part of the casing 44 and communicates with the air outlet 48 and guides the fluid blown out of the centrifugal fan 1 to the air outlet 48.

The shape of the main plate 2 of the centrifugal fan 1 in FIG. 1 is not limited to that illustrated in FIG. 1. For example, the main plate 2 may be substantially flat and plate-shaped or may be a flat plate having protrusions such as ribs. Furthermore, the main plate 2 may have a shape with protrusions at its periphery to balance the center of gravity, a shape with a hole for weight reduction or cooling, a shape with a cup-shaped raised portion located at the center of rotation, or a shape with notches between the blades or may have a combination of these shapes. In Embodiment 1, the hub 3, which is a cup-shaped raised portion, is disposed around a hole 3*a*, which is in connection with the fan motor 50 located on the rotation axis X. The flat main plate 2 is disposed at the periphery of the hub 3.

The shape of the hub 3 is not limited to that illustrated in FIG. 1. The hub 3 may have, for example, a shape with a cup-shaped raised portion at the center of rotation, a shape with a cooling hole for weight reduction and cooling, or a shape with protrusions such as ribs or may include a rubber vibration isolator to reduce vibration during rotation.

The hole 3*a* of the main plate 2 or the hub 3 may have a circular, elliptical, or substantially polygonal shape. The main plate 2 or the hub 3 may have multiple holes 3*a*. The multiple holes 3*a* may have different shapes.

The blades 4 stand from the main plate 2 and are arranged at regular intervals circumferentially about the rotation axis X of the centrifugal fan 1. The blades 4 may be arranged at irregular intervals. The blades 4 may have the same shape or different shapes. An end of each blade 4 connected to the main plate 2 is referred to as a main-plate-side end 4*c*.

The shroud 5 is connected to an end of each blade 4 opposite from the main-plate-side end 4*c*. The end of each blade 4 connected to the shroud 5 is referred to as a shroud-side end 4*d*. The shroud 5 has an annular shape having a central opening as the centrifugal fan 1 is viewed in a direction along the rotation axis X.

Although the shroud 5 has an annular shape in Embodiment 1, the shroud 5 may have another shape, such as an elliptical shape and a polygonal shape.

The shroud 5 includes protrusions 5*c* arranged for connection to the blades 4. Although the protrusions 5*c* protrude from a shroud outer surface 5*b* when the shroud 5 is viewed from the position where the shroud outer surface 5*b* is located, holes are arranged in a shroud inner surface 5*a* as the shroud 5 is viewed from the position where the shroud inner surface 5*a* is located. The shroud-side end 4*d* of each blade 4 includes a protruding insertion portion, which is not illustrated. The insertion portions are inserted into the holes of the shroud inner surface 5*a*, so that the blades 4 are connected to the shroud 5.

In a section of the centrifugal fan 1 containing the rotation axis X, the surface of the shroud 5 includes arc-shaped portions. The surface of the shroud 5 in a section containing the rotation axis X may include elliptical-arc-shaped portions or may have a curve obtained by combining different curves. The shroud inner surface 5*a*, which is a surface of the shroud 5 located close to the blades 4, may have a different sectional shape from that of the shroud outer surface 5*b*, which is a surface opposite the shroud inner surface 5*a*. An outer circumferential face 5*d* of the shroud 5 may have a groove to balance the centrifugal fan 1. Furthermore, the shroud 5 may have any of, for example, a shape with a hole for weight reduction, a shape with protrusions such as ribs, and a shape with notches in parts between the blades 4 or may have a combination of these shapes.

Figure 4:
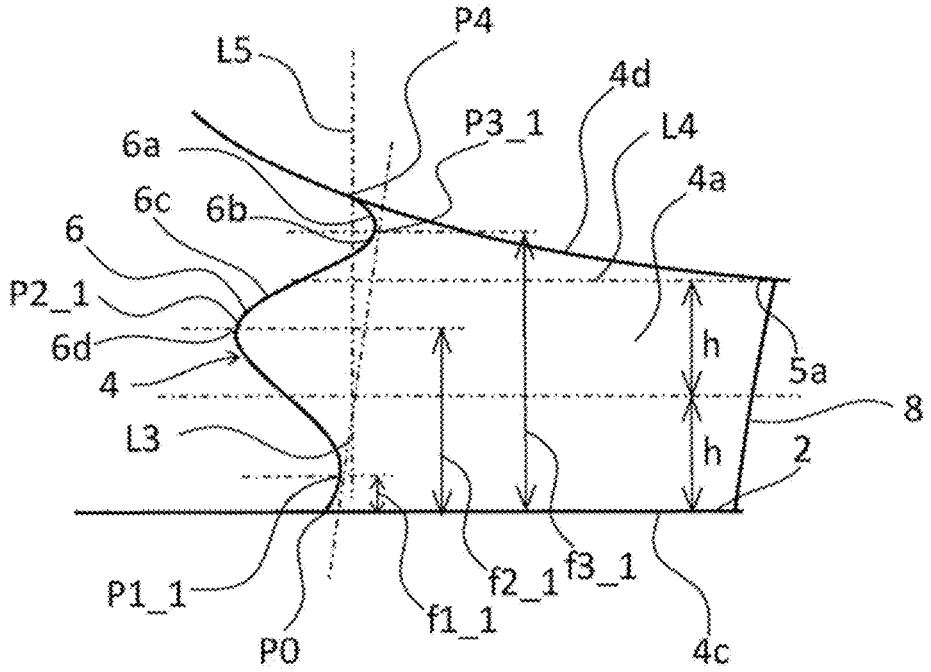
FIG. 4 is a diagram illustrating the shape of each blade of the centrifugal fan according to Embodiment 1.

FIG. 4 is a diagram illustrating the shape of each blade 4 of the centrifugal fan 1 according to Embodiment 1. FIG. 4 illustrates a suction surface 4*a* of the blade 4. In other words, FIG. 4 illustrates a projection of the blade 4 as the blade 4 is viewed from the rotation axis X of the centrifugal fan 1. In Embodiment 1, the blade 4 is three-dimensionally twisted rather than being flat. FIG. 4 conveniently illustrates the blade 4 developed on a flat surface. In FIG. 4, only the surfaces of the main plate 2 and the shroud 5 connected to the blade 4 are schematically illustrated.

An edge of the blade 4 located on the left of FIG. 4 is referred to as a leading edge 6, which is a front edge in the rotation direction of the centrifugal fan 1. An edge of the blade 4 located on the right of FIG. 4 is referred to as a trailing edge 8, which is a rear edge in the rotation direction of the centrifugal fan 1. The leading edge 6 is closer to the rotation axis X of the centrifugal fan 1 than is the trailing edge 8. The trailing edge 8 is located at an outer circumference of the centrifugal fan 1.

With reference to FIG. 4, the shroud-side end 4*d* is joined to the shroud 5, and the main-plate-side end 4*c* is joined to the main plate 2. In FIG. 4, the shroud inner surface 5*a* in contact with the shroud-side end 4*d* is shaped to fit the shroud-side end 4*d* of the blade 4 and is defined by a curve that gradually approaches the main plate 2 in a direction from the leading edge 6 to the trailing edge 8 of the blade 4.

As illustrated in FIG. 4, the leading edge 6 includes connection part 6*a*, which is in proximity to the shroud inner surface 5*a*. The connection part 6*a* intersects the shroud inner surface 5*a* to form an acute angle, namely, an angle of 90 degrees or less with the shroud inner surface 5*a*. In other words, the leading edge 6 extends obliquely from a point P4, which is the point of intersection of the leading edge 6 and the shroud inner surface 5*a*, toward the trailing edge 8.

As illustrated in FIG. 4, the connection part 6*a* of the leading edge 6 of the blade 4 connects to the shroud inner surface 5*a* at an acute angle formed between the connection part 6*a* and the shroud inner surface 5*a*. The connection part 6*a* is part of a recess 6*b*, which curves inwardly from the leading edge. In other words, the recess 6*b* is located next to the point P4 and defines a valley-like shape having a bottom at a point P3_1 when the recess 6*b* is viewed from the center of rotation. The leading edge 6 extends from the point P3_1, which is the bottom of the recess 6*b*, to a tip 6*d* in the rotation direction and extends from the tip 6*d* toward the trailing edge 8 to form a projection 6*c* projecting in the rotation direction. In other words, the projection 6*c* has an inverted-V shape with a peak at the tip 6*d* when the projection 6*c* is viewed from the center of rotation. An end of the projection 6*c* close to the main plate 2 is located at a point P1_1. The leading edge 6 extends from the point P1_1 to the main plate 2 and connects to the main plate 2 at a point P0.

In other words, the blade 4 includes the projection 6*c* projecting from a reference line L3, which is a reference curve for the leading edge 6 of the blade 4, in the rotation direction at the leading edge 6. In the blade 4, the leading edge 6 extends from the point P1_1, which is located at one of opposite ends of the projection 6*c* and is close to the main plate 2, to the main plate 2 in the rotation direction, and the connection part 6*a* of the leading edge 6 extends from the point P3_1, which is located at the other one of the opposite ends of the projection 6*c* and is close to the shroud 5, in the rotation direction.

In Embodiment 1, the reference line L3 for the leading edge 6 is represented as a tangent passing through the point P1_1 and the point P3_1 at the opposite ends of the projection 6*c* in FIG. 4 and is represented as a straight line inclined toward the trailing edge 8 in a direction from the main plate 2 toward the shroud 5. However, the reference line L3 is a curve extending along the three-dimensionally twisted shape of the actual blade 4 and passing through the points P1_1 and P3_1. The reference line L3 is not limited to such a curve. For example, the reference line L3 may be a straight line perpendicular to the main plate 2 or a straight line inclined at an angle to the main plate 2. Or alternatively, the reference line L3 may be a curve monotonically curving in the rotation direction in a direction away from the main plate 2, a curve monotonically curving in a direction opposite to the rotation direction in the direction away from the main plate 2, or a curve curving in a radial direction or in a direction opposite to the radial direction in the direction away from the main plate 2.

Figure 5:
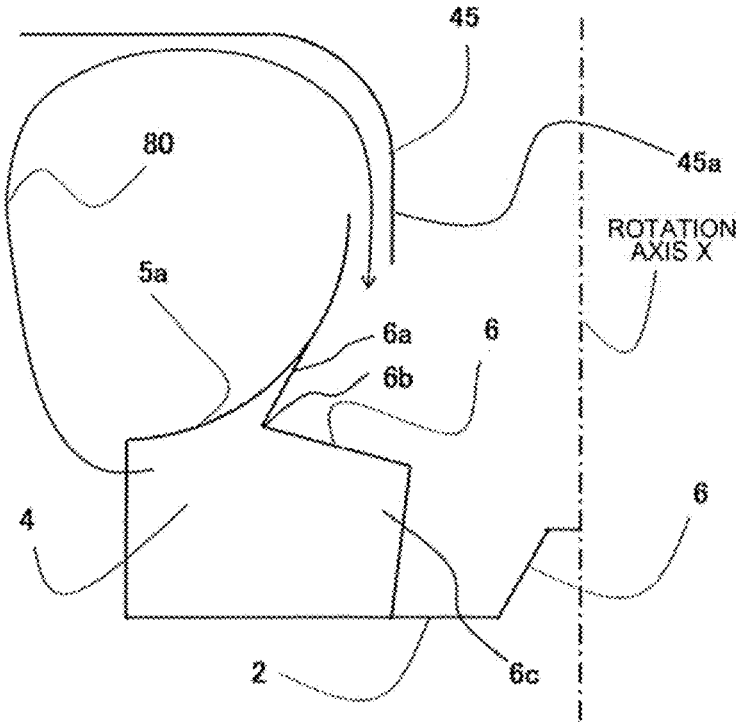
FIG. 5 is a schematic diagram of the structure of the centrifugal fan according to Embodiment 1 in a section containing a rotation axis X.

FIG. 5 is a schematic diagram of the structure of the centrifugal fan 1 according to Embodiment 1 in a section containing the rotation axis X. In FIG. 5, the shapes of the bell mouth 45 and the shroud 5 are schematically represented by lines. FIG. 5 schematically illustrates connection between the centrifugal fan 1 and the bell mouth 45. As illustrated in FIG. 2, the centrifugal fan 1 is connected to the air inlet passage 51 by the bell mouth 45. The bell mouth 45 has a shape with a decreasing diameter such that the opening gradually decreases in diameter in the direction from the air inlet passage 51 to the centrifugal fan 1. With reference to FIG. 5, the bell mouth 45 is connected to the centrifugal fan 1 such that a small-diameter end 45*a* of the bell mouth 45 enters the central opening of the shroud 5 of the centrifugal fan 1.

In the heat source unit 40 according to Embodiment 1, while the centrifugal fan 1 is driven, part of the fluid discharged radially from the centrifugal fan 1 passes through the space between an outer circumferential surface of the bell mouth 45 and the inner circumferential surface of the shroud and is guided to the shroud 5 of the centrifugal fan 1. Such a flow circulating in the casing 44 is referred to as a circulating flow 80. The circulating flow 80, which is a fluid that flows out of the centrifugal fan 1 and again enters the centrifugal fan 1 through the central opening of the shroud 5, flows at high velocity.

Collision between the circulating flow 80, which flows at high velocity, and the leading edge 6 of each blade 4 causes flow separation on the suction surface of the blade 4. The circulating flow 80, which enters the space defined by the shroud 5 and the bell mouth 45 and flows in a region close to the shroud inner surface 5*a*, causes a stall zone to occur in a region adjacent to the shroud inner surface 5*a* on the suction surface 4*a* of the blade 4. The stall zone on the suction surface 4*a* reduces a flow rate through the centrifugal fan 1 and the efficiency of the centrifugal fan 1 and also causes noise.

As illustrated in FIG. 4, the leading edge 6 of the blade 4 has the recess 6*b*, which includes the connection part 6*a* of the leading edge 6 at an acute angle with the shroud inner surface 5*a*, and the projection 6*c* extending from the reference line L3 for the leading edge 6 in the rotation direction. This shape can mitigate collision between the circulating flow 80 and the leading edge 6, so that flow separation at the leading edge 6 of the blade 4 is reduced. The reduced flow separation results in a significant reduction in stall zone that occurs in a region adjacent to the shroud 5 on the suction surface 4*a* between the leading edge 6 of the blade 4 located close to the rotation axis X and the trailing edge 8 of the blade 4 located at the outer circumference, and noise from the centrifugal fan 1 is thus reduced and a flow rate through the centrifugal fan 1 is thus increased.

The trailing edge 8 of the blade 4 of the centrifugal fan 1 may have a linear shape parallel to the rotation axis X, a spiral shape, or a shape formed by combining multiple spiral shapes. Furthermore, the trailing edge 8 may have a set of triangular serrations like the teeth of a saw or may have a notch.

Embodiment 2

In the centrifugal fan 1 according to Embodiment 1, the shape of the leading edge 6 of each blade 4 can be modified. In particular, the leading edge 6 can have a plurality of projections 6*c*. In Embodiment 2, a modification to Embodiment 1 is mainly described. Hereinafter, an imaginary plane parallel to the main plate 2 is defined in the centrifugal fan 1, and a distance from the point of intersection of the imaginary plane and the leading edge 6 of the blade 4 to the point of intersection of the imaginary plane and the trailing edge 8 of the blade 4 along the suction surface is defined as a circumferential length.

The height of an opening, through which the fluid is blown out of the centrifugal fan 1, at the outer circumference of the centrifugal fan 1 in FIG. 4 is referred to as an outlet height. The outlet height is a distance from the periphery of the main plate 2 to the periphery of the shroud 5 at the outer circumference of the centrifugal fan 1.

Half the outlet height is a distance h. In other words, the outlet height is expressed as 2*h*.

As illustrated in FIG. 4, the point of connection between the leading edge 6 of the blade 4 and the main plate 2 is referred to as a point P0. A start point of a first projection 6*c*, which is the first from the main plate 2, of the leading edge 6 is referred to as a point P1_1. A point at which the blade 4 has the longest circumferential length in the first projection, which is the first from the main plate, of the leading edge 6 is referred to as a point P2_1. An end point of the first projection 6*c*, which is the first from the main plate 2, of the leading edge 6 is referred to as a point P3_1. The point of connection between the leading edge 6 and the shroud inner surface 5*a* is referred to as a point P4. As long as the reference line L3 for the leading edge 6 is parallel to the trailing edge 8 as illustrated in FIG. 4, the point P2_1 coincides with the tip 6*d* of the projection 6*c*.

In other words, in a case in which the leading edge 6 includes a plurality of projections, the start point of the kth projection 6*c*, which is the kth from the main plate 2, is represented as a point P1_*k*, the peak of the kth projection is represented as a point P2_*k*, and the end point of the kth projection 6*c* is represented as a point P3_*k*. The point P1_*k* is a point that is located at one of opposite ends of the kth projection 6*c* of the plurality of projections 6*c* and is located close to the main plate 2. The point P3_*k* is a point that is located at the other one of the opposite ends of the kth projection 6*c*, which is the kth from the main plate 2, of the plurality of projections and is located close to the shroud 5. The point P1_*k* may coincide with the point P3_k-1.

A distance from the main plate 2 to the point P1_1 along the rotation axis X of the centrifugal fan 1 is represented as a distance f1_1, a distance from the main plate 2 to the point P2_1 along the rotation axis X of the centrifugal fan 1 is represented as a distance f2_1, and a distance from the main plate 2 to the point P3_1 along the rotation axis X of the centrifugal fan 1 is represented as a distance f3_1. In other words, the relationship of f1_*k*<f2_*k*<f3_*k* holds in the kth projection from the main plate 2.

With reference to FIG. 4, the circumferential length of the blade 4 at the point P2 1 P2_1 is longer than that at the point P1_1. In addition, the circumferential length of the blade 4 at the point P2_1 is longer than that at the point P3_1. This configuration reduces flow separation at the leading edge 6 of the blade 4 so that noise from the centrifugal fan 1 is reduced and a flow rate through the centrifugal fan 1 is increased.

Although FIG. 4 illustrates the leading edge 6 including the single projection 6*c* located closer to the main plate 2 than is the recess 6*b* in the centrifugal fan 1, the leading edge 6 may include a plurality of projections 6*c*. In the leading edge 6 including a plurality of projections 6*c*, the nth projection 6*c*, which is the nth from the main plate 2, is set such that the circumferential length of the blade 4 at a point P2_*n* is longer than that at a point P1_*n* and is longer than that at a point P3_*n*.

Preferably, a point at which the blade 4 has the longest circumferential length is located closer to the shroud 5 than a point that corresponds to half the outlet height. In other words, in a case in which the leading edge 6 includes the single projection 6*c* as illustrated in FIG. 4, the position of the point P2_1 is set to satisfy f2_1 >h. For a plurality of projections, the position of the point P2_n on any or the nth projection 6*c* is set to satisfy f2_n >h. Such a configuration is effective in reducing flow separation at the leading edge 6.

In particular, for example, in the air-conditioning-apparatus heat source unit 40 in which a pressure-loss causing object, for example, the heat exchanger 43, is located downstream of the blades 4, flow separation at the leading edge 6 of each blade 4 is efficiently reduced. Thus, a stall zone that occurs in a shroud-side region on the suction surface 4*a* between the leading edge 6 of the blade 4 to the trailing edge 8 of the blade 4 can be significantly reduced, so that noise from the centrifugal fan 1 is reduced and a flow rate through the centrifugal fan 1 is increased.

Figure 6:
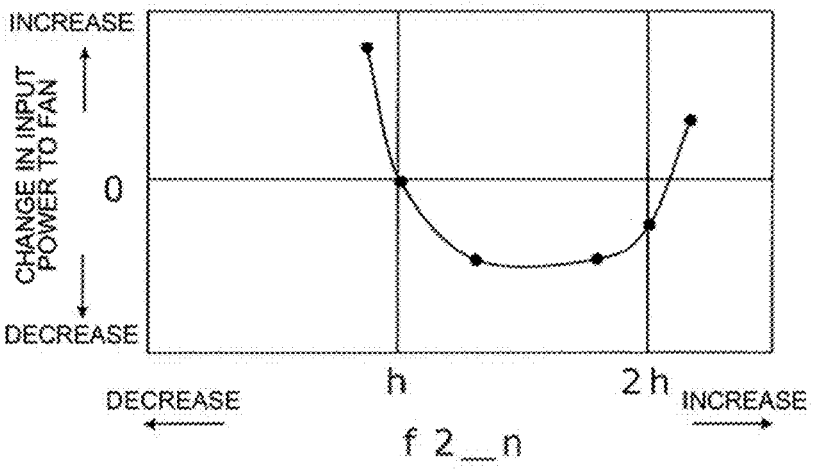
FIG. 6 is a graph illustrating the relationship between the position of a point on a projection of the blade and a change in input power to the centrifugal fan.

FIG. 6 is a graph illustrating the relationship between the position f2_n of the point P2_n on the projection of the blade 4 and a change in input power to the centrifugal fan 1. In FIG. 6, the horizontal axis represents f2_n representing the position of the point P2_n, which is at the tip of the nth projection from the main plate 2, on the blade 4 and the vertical axis represents input power to the centrifugal fan 1 under conditions where air is blown out of the centrifugal fan 1 at a constant flow rate. Specifically, as input power to the centrifugal fan 1 represented by the vertical axis is lower, the air can be discharged at the same flow rate with lower input power. In this state, the centrifugal fan 1 achieves high efficiency.

As illustrated in FIG. 6, setting the position at which the blade 4 has the longest circumferential length to satisfy f2_n>h, which is greater than half the outlet height, can reduce input power to the centrifugal fan to improve the efficiency of the fan.

Setting the position of the point P2_*n*, at which the blade 4 has the longest circumferential length, to satisfy 1.3 h f2_*n*≤1.8 h can further reduce input power to the centrifugal fan 1. The reason is as follows. If the point P2_n, at which the circumferential length of the blade 4 is long, was located at a higher level than the height of the trailing edge 8, the distance between the leading edge 6 of each blade 4 and the next blade 4 would decrease, and pressure loss between the blades 4 would thus increase. However, locating the point P2_n, at which the blade 4 has the longest circumferential length, between a level corresponding to half the height of the trailing edge 8 and an upper end of the trailing edge 8 as described above can improve the efficiency of the centrifugal fan 1. Furthermore, the circumferential length of the blade 4 at the point P2_*n* on the projection 6*c* is preferably set to 1.1 to 2.0 times the circumferential length of the blade 4 at the point P0 on the main plate 2.

Embodiment 3

The efficiency of the centrifugal fan 1 according to Embodiment 1 can be further improved by setting the position of the projection 6*c* of the leading edge 6 of each blade 4 to satisfy the following condition. In Embodiment 3, a modification to Embodiment 1 is mainly described.

In Embodiment 3, in a case in which the leading edge 6 of each blade 4 includes a single projection 6*c*, the projection 6*c* is located such that the distance between the main plate 2 and the point P1_1 at one of the opposite ends of the projection 6*c* satisfies "0.05×2 h≤f1_1≤0.2×2 h" and the distance between the main plate 2 and the point P3_1 at the other one of the opposite ends of the projection 6*c* satisfies "0.8×2 h≤f3_1≤1.3×2 h". Such a configuration allows the recess 6*b* to be located in a flow boundary layer that is generated along the shroud inner surface 5*a* by the circulating flow 80 illustrated in FIG. 5, and collision between the circulating flow 80 and the leading edge 6 is thus mitigated. Even if the number of projections 6*c* included in the leading edge 6 of each blade 4 is one, flow separation at the leading edge 6 can therefore be effectively reduced, and a flow rate through the centrifugal fan 1 is thus increased. The point P3_1, which is located at the end of the projection 6*c* close to the shroud 5, coincides with the bottom of the recess 6*b*. The point P3_1 also represents a position where the recess 6*b* is located.

Furthermore, the point P3_1 on the leading edge 6 may be located between the shroud inner surface 5*a* and a plane offset from the shroud inner surface 5*a* by 0.3 h toward the main plate 2 along the rotation axis X. Such a configuration allows the recess 6*b* to be located in a flow boundary layer that is generated along the shroud inner surface 5*a* by the circulating flow 80. This configuration can thus more effectively reduce flow separation at the leading edge 6 of each blade 4 to improve the efficiency of the centrifugal fan 1.

Furthermore, the recess 6*b* may be located at a level higher than or equal to the upper end of the trailing edge 8. In other words, the point P3_1 may satisfy a condition of "2 h≤f3_1". In this case, it is difficult to locate the bottom of the recess 6*b* closer to the trailing edge 8.

Embodiment 4

The efficiency of the centrifugal fan 1 according to Embodiment 1 can be further improved by setting the shape of part of the projection 6*c* of the leading edge 6 of each blade 4 that is close to the shroud 5 to satisfy the following condition. In Embodiment 4, a modification to Embodiment 1 is mainly described.

As illustrated in FIG. 4, when the leading edge 6 of the blade 4 of the centrifugal fan 1 is radially projected, the projection 6*c* of the leading edge 6 preferably has a shape defined by a smooth curve such that a change in shape increases between the points P2_n and P3_n. Specifically, the leading edge 6 provides a large change in circumferential length between the points P2_n and P3_n in a direction toward the shroud 5 along the rotation axis X. On the leading edge 6 of each blade 4 of the centrifugal fan 1, the circulating flow 80 increases flow velocity at a position close to the shroud inner surface 5*a*. However, the above-described leading edge 6 of each blade 4 included in the centrifugal fan 1 allows air to flow along the blade 4 even in a region adjacent to the shroud 5 that is significantly affected by the circulating flow 80. This configuration reduces flow separation in the region adjacent to the shroud 5 on the suction surface 4*a* of the blade 4 and increases a flow rate through the centrifugal fan 1.

Embodiment 5

The efficiency of the centrifugal fan 1 according to Embodiment 1 can be improved by shaping part of the projection 6*c* of the leading edge 6 of each blade 4 that is close to the shroud 5 in the following manner. In Embodiment 5, a modification to Embodiment 1 is mainly described.

As illustrated in FIG. 4, when the leading edge 6 of the blade 4 of the centrifugal fan 1 is radially projected, part of the projection 6*c* of the leading edge 6 that is located between P2_*n* and P3_*n* can have a shape including a sinusoidal shape corresponding to at least half a cycle of a sine curve or a shape similar to a sine curve. In the centrifugal fan 1, the circulating flow 80 increases flow velocity in a region close to the shroud inner surface 5*a* on the suction surface 4*a* of the leading edge 6 of each blade 4. However, the above-described shape of the leading edge 6 allows the suction surface 4*a* of the leading edge 6 of each blade 4 to fit a flow even in a region adjacent to the shroud 5 that is significantly affected by the circulating flow 80, and flow separation is thus effectively reduced.

In a case in which the shroud 5 of the centrifugal fan 1 is not rotated, the circulating flow 80 flowing between the bell mouth 45 and the shroud 5 along the rotation axis behaves like a Poiseuille flow, and the flow velocity distribution of the flow two-dimensionally changes in a section containing the rotation axis X. However, as the shroud 5 is rotated actually, the fluid flowing between the shroud 5 and the bell mouth 45 changes in circumferential component of its flow velocity. In other words, the fluid flowing along the shroud 5 behaves like a Couette flow, and its radial velocity component is higher toward the outer circumference of the centrifugal fan 1. The flow velocity of the fluid is determined by combining a circumferential velocity component and an axial velocity component of the fluid. For the flow between the shroud 5 and the bell mouth 45, therefore, part of the flow that is adjacent to the shroud 5 flows at higher velocity and part of the flow that is adjacent to the bell mouth 45 flows at lower velocity. For the fluid flowing through the centrifugal fan 1, therefore, a change in flow velocity in a region adjacent to the shroud (on an outside-diameter region) is smaller than that in a region adjacent to the bell mouth 45 (on an inside-diameter region). The degree of turbulence of a flow depends on the velocity of the flow. It is therefore preferred that the shape of each blade 4 be changed to match a change in flow velocity. Specifically, the shape of the blade 4 is effectively changed such that a change in shape decreases toward the shroud 5 and increases away from the shroud 5. In Embodiment 5, the leading edge 6 of each blade 4 has, for example, a shape of a sine curve or a shape similar to a sine curve. The shape of the leading edge 6 is not limited to these examples.

Embodiment 6

For the centrifugal fan 1 according to Embodiment 1, part of the projection 6*c* of the leading edge 6 of each blade 4 that is close to the shroud 5 can be set to satisfy the following condition. In Embodiment 6, a modification to Embodiment 1 is mainly described.

As illustrated in FIG. 4, when the leading edge 6 of the blade 4 of the centrifugal fan 1 is radially projected, the nth projection 6*c*, which is the nth from the main plate 2, of the leading edge 6 has the longest circumferential length between the points P1_*n* and P2_*n*. In a configuration in which the leading edge 6 includes a plurality of projections 6*c*, the circumferential length of the projection 6*c* located close to the shroud 5 is set to be longer than that located close to the main plate 2. The projections 6*c* are connected by a smooth curve, and a flow rate through the centrifugal fan 1 is thus increased.

Embodiment 7

For the centrifugal fan 1 according to Embodiment 1, an angle formed by the connection part 6*a* of the leading edge 6 of each blade 4 and the shroud 5 can be changed. In Embodiment 7, a modification to Embodiment 1 is mainly described.

Figure 7:
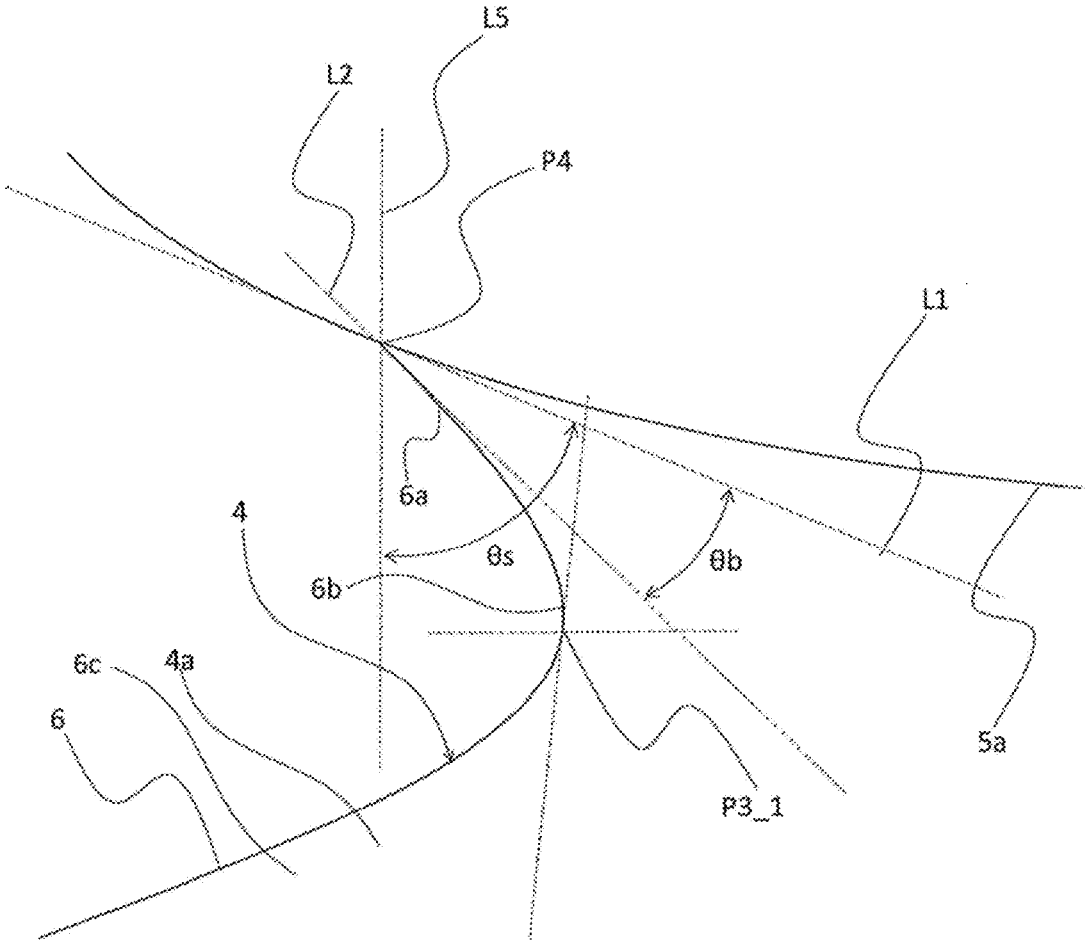
FIG. 7 is an enlarged view illustrating connection part of the blade of the centrifugal fan in FIG. 4 and its surroundings.

FIG. 7 is an enlarged view illustrating the connection part 6*a* of the blade 4 of the centrifugal fan 1 in FIG. 4 and its surroundings. Specifically, FIG. 7 illustrates details of the connection part 6*a* located between the recess 6*b* of the blade 4 of the centrifugal fan 1 and the shroud inner surface 5*a*. As illustrated in FIG. 7, the point of intersection of the blade 4 of the centrifugal fan 1 and the shroud inner surface 5*a* is a point P4, θs is an angle formed by a tangent L1 to the shroud inner surface 5*a* and a straight line L5 passing through the point P4 and parallel to the rotation axis X on the plane illustrated in FIGS. 4 and 7, and θb is an angle formed by the tangent L1 to the shroud inner surface 5*a* and a tangent L2 to the leading edge 6 of the blade 4 that passes through the point P4 on the plane illustrated in FIGS. 4 and 7. The shape of the connection part 6*a* of the leading edge 6 that extends to the shroud 5 is preferably set to satisfy 0 degrees≤θb<θs. The shape of the leading edge 6 of the blade 4 set as described above can reduce flow separation caused by collision between the circulating flow 80 flowing from the shroud inner surface 5*a* and the leading edge 6 of the blade 4. As a stall zone caused by flow separation on the suction surface 4*a* of the blade 4 is thus reduced, a flow rate through the centrifugal fan 1 is increased and the efficiency of the fan is improved.

Although FIG. 7 illustrates the single point P4, multiple sections can be set in the circumferential direction, and the shape of the blade 4 that extends to the shroud 5 can be set to satisfy 0 degrees≤θb<θs in any of the set sections. As the effect of reducing flow separation is thus enhanced, the efficiency of the fan is improved.

Figure 8:
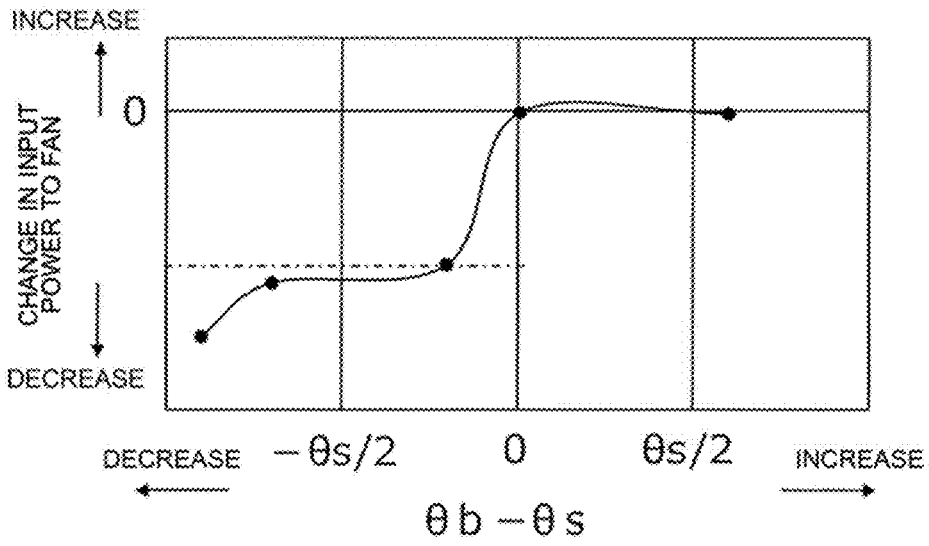
FIG. 8 is a graph illustrating a change in input power to the centrifugal fan associated with a change in angle θb and a change in angle θs in the centrifugal fan.

FIG. 8 is a graph illustrating a change in input power to the centrifugal fan 1 associated with a change in angle θb and a change in angle θs in the centrifugal fan 1. The horizontal axis represents a change in θb−θs and the vertical axis represents a change in input power to the centrifugal fan 1 under conditions where the fluid flows through the centrifugal fan 1 at a constant flow rate. FIG. 8 demonstrates that as input power to the centrifugal fan 1 represented by the vertical axis is lower, the fluid can be discharged at the same flow rate with lower input power. A lower value on the vertical axis represents higher efficiency of the centrifugal fan 1.

In FIG. 8, θb−θs≥0 represents that part of the leading edge 6 that is connected to the shroud inner surface 5*a* has no recess 6*b*, and θb−θs<0 represents that part of the leading edge 6 that is connected to the shroud inner surface 5*a* has a recess 6*b*. As illustrated in FIG. 8, setting the centrifugal fan 1 to satisfy θb−θs<0, that is, 0 degrees≤θb<θs can reduce input power to the centrifugal fan 1 to improve the efficiency of the centrifugal fan 1.

Embodiment 8

The angle formed by the connection part 6*a* of the leading edge 6 of each blade 4 and the shroud 5 in the centrifugal fan 1 according to Embodiment 1 can be changed. In Embodiment 8, a modification to Embodiment 7 is mainly described.

Although the angles θb and θs are set to satisfy 0 degrees θb≤θ<θs in Embodiment 7 described above, setting the angles θb and θs to satisfy 0 degrees θs/2 can further enhance the effect of reducing flow separation on the suction surface 4*a*. As illustrated in FIG. 8, setting the angles θb and θs to satisfy θb−θs<−θs/2 reduces input power to the centrifugal fan represented by the vertical axis. In other words, setting the angles θb and θs to satisfy 0 degrees θb <θs/2 can further reduce flow separation at the leading edge 6 of each blade 4, and input power to the centrifugal fan 1 is thus further reduced. The efficiency of the centrifugal fan 1 is thus improved.

Embodiment 9

The efficiency of the centrifugal fan 1 according to Embodiment 1 can be improved by further specifying the angle formed by the connection part 6*a* of the leading edge 6 of each blade 4 and the shroud 5. In Embodiment 9, a modification to Embodiment 8 is mainly described.

For the leading edge 6 of each blade 4, setting the angle θs to satisfy 0 degrees≤θs<60 degrees can enhance the effect of reducing flow separation at the leading edge 6 of the blade 4. The fluid flowing through the centrifugal fan 1 passes the shroud 5, the leading edge 6 of each blade 4, the surface of the blade 4, and the trailing edge 8 of the blade 4, and is then discharged from the centrifugal fan 1. An air passage defined by the shroud inner surface 5*a*, the main plate 2, and the hub 3 decreases in cross-sectional area in a downstream direction, and the fluid passing through the centrifugal fan 1 is thus caused to flow at a higher velocity as the fluid moves downstream. As the fluid moves downward, the degree of turbulence of the flow through the centrifugal fan 1 therefore decreases. Collision between the leading edge 6 and the flow of the fluid at a position with a higher degree of turbulence of the flow increases a likelihood of separation of the flow from the blade surface. Collision between the leading edge 6 and the flow of the fluid at a position with a lower degree of turbulence of the flow therefore reduces the likelihood of separation of the flow from the blade surface. In other words, as the recess 6*b* of the leading edge 6 of the blade 4 causes the fluid to collide with the leading edge 6 on the outside-diameter region of the centrifugal fan 1, the effect of reducing flow separation is further enhanced. The effect of reducing flow separation can therefore be further enhanced by connecting the leading edge 6 of the blade 4 at a position where the angle θs, which is the angle formed by the tangent to the shroud inner surface 5*a*, satisfies 0 degrees≤θs<60 degrees. If θs was greater than or equal to 60 degrees, the blade 4 would have a smaller length and would not work on the fluid, so that the effect of improving the efficiency of the centrifugal fan 1 would be reduced.

Embodiment 10

The efficiency of the centrifugal fan 1 according to Embodiment 1 can be improved by further specifying an angle formed by the suction surface 4*a* of each blade 4 and the shroud inner surface 5*a* in a section containing the rotation axis X of the centrifugal fan 1.

Figure 9:
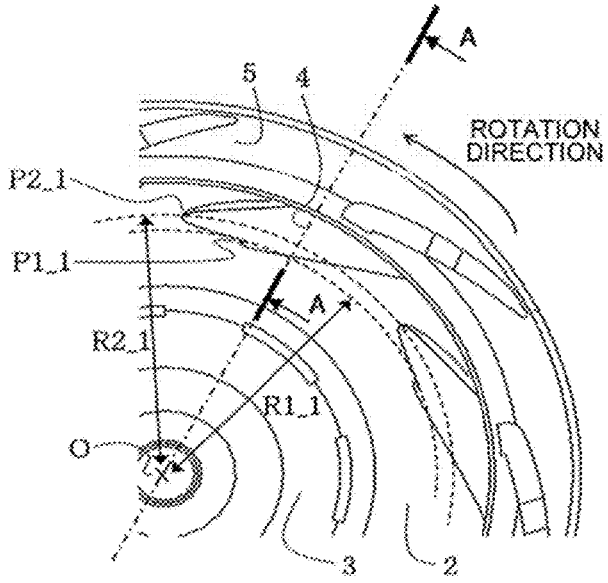
FIG. 9 is a plan view of the centrifugal fan of FIG. 1 as the centrifugal fan is viewed from the position where a shroud is located.
Figure 10:
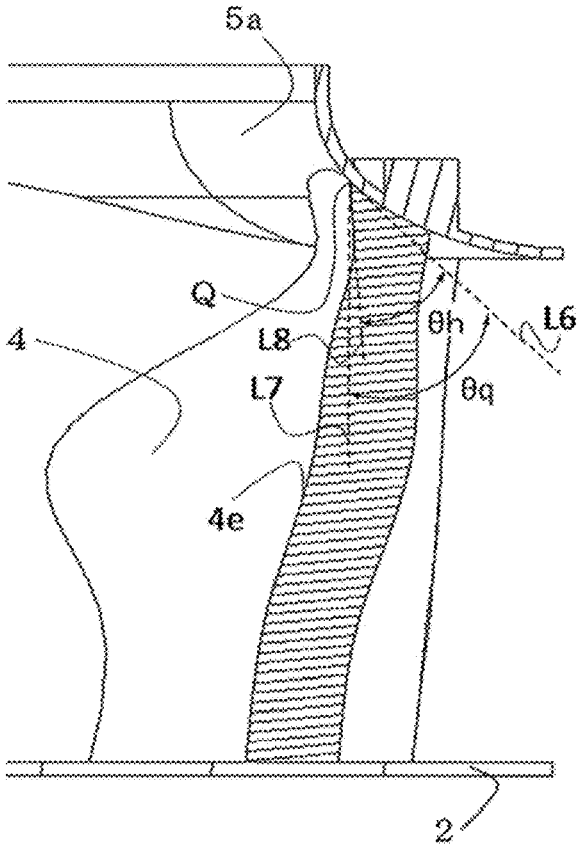
FIG. 10 is a diagram illustrating a section of the centrifugal fan of FIG. 1 that contains the rotation axis.

FIG. 9 is a plan view of the centrifugal fan 1 of FIG. 1 as the centrifugal fan 1 is viewed from the position where the shroud 5 is located. FIG. 10 is a diagram illustrating a section of the centrifugal fan 1 of FIG. 1 that contains the rotation axis X.

FIG. 10 illustrates a section of part A-A in FIG. 9. As illustrated in FIG. 10, in the section A-A, a line representing the suction surface 4*a* of the blade 4 of the centrifugal fan 1 is a cutting-plane line 4*e*, and the point of intersection of the cutting-plane line 4*e* and the shroud inner surface 5*a* is a point Q. Furthermore, in the section A-A, an angle formed by a tangent L6 to the shroud inner surface 5*a* and a straight line L7 passing through the point Q and parallel to the rotation axis X is an angle θq, and an angle formed by the tangent L6 to the shroud inner surface 5*a* and a tangent L8 to the cutting-plane line 4*e* of the blade 4 and passing through the point Q is an angle θh.

The suction surface 4*a* of the blade 4 and the shroud inner surface 5*a* can be set such that the relationship between the angles θq and θh satisfies 0 degrees≤θh<θq. Such a configuration reduces flow separation caused by collision of the circulating flow 80 flowing to the shroud inner surface 5*a* with the suction surface 4*a* of the blade 4, and a stall zone caused by flow separation on the suction surface 4*a* of the blade 4 is thus reduced. This configuration leads to an increased flow rate through the centrifugal fan 1 to improve the efficiency of the centrifugal fan 1. When the part A-A is set at any position in the circumferential direction, and the shape of the blade 4 and that of the shroud 5 are set such that the above-described relationship of 0 degrees≤θh<θq holds in any of the set sections, separation of part of the flow that passes the shroud inner surface 5*a* and flows to the suction surface 4*a* of the blade 4 is reduced. As a flow rate through the centrifugal fan 1 is thus increased, the efficiency of the centrifugal fan 1 is improved and noise generated by flow separation is reduced.

Figure 11:
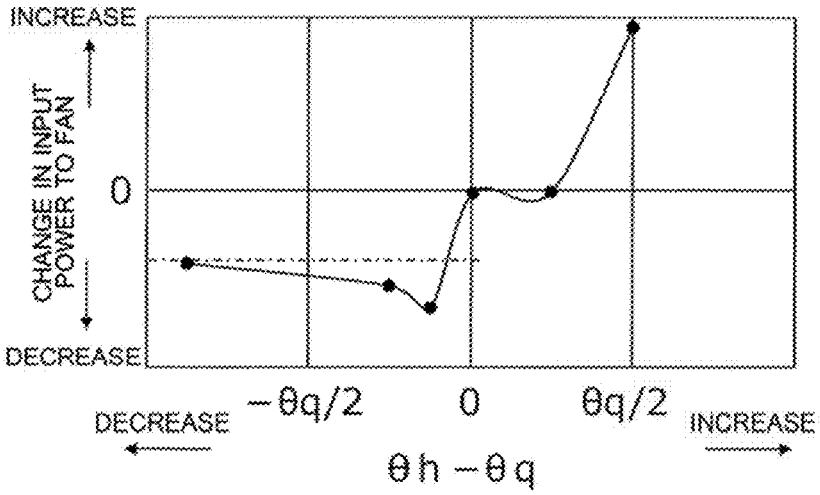
FIG. 11 is a graph illustrating a change in input power to the centrifugal fan associated with a change in angle θq and a change in angle θh in the centrifugal fan.

FIG. 11 is a graph illustrating a change in input power to the centrifugal fan 1 associated with a change in angle θq and a change in angle θh in the centrifugal fan 1. The horizontal axis represents a change in θh−θq and the vertical axis represents a change in input power to the centrifugal fan 1 under conditions where the fluid flows through the centrifugal fan 1 at a constant flow rate. As illustrated in FIG. 11, setting θh−θq<0, that is, 0 degrees≤θh<θq can reduce input power to the centrifugal fan 1 to improve the efficiency of the centrifugal fan 1.

As illustrated in FIG. 10, the thickness of the blade 4 is not necessarily constant in a section of the centrifugal fan 1 that contains the rotation axis X. In other words, the shape of a pressure surface 4*b* of the blade 4 can be appropriately set irrespective of the shape of the suction surface 4*a* of the blade 4.

Embodiment 11

The centrifugal fan 1 is not limited to the above-described embodiments. The efficiency of the centrifugal fan 1 can be further improved by further specifying the relationship between the angles θh and θq in Embodiment 10. Although 0 degrees θh<θq in Embodiment 10 is described above, setting θq/2≤θh<θq further reduces input power to the centrifugal fan 1 to improve the efficiency of the centrifugal fan 1.

As illustrated in FIG. 11, setting −θq/2≤θh−θq<0, that is, setting the angle θh to satisfy θq/2≤θh<θq can further reduce input power to the centrifugal fan 1 to improve the efficiency of the centrifugal fan 1. If the shape of the suction surface 4*a* of each blade 4 was set to satisfy 0≤θh−θq<θq/2, that is, if the angle θh was set to satisfy 0≤θh<3θq/2, flow separation on the suction surface 4*a* of the blade 4 would be reduced, and the flow rate would also be reduced because of a reduction in force applied from the blade 4 to the fluid. The reason is that the effect of reducing the flow rate is greater than the effect of reducing flow separation when these effects are compared with each other under the same flow rate condition in the centrifugal fan 1. Setting θq/2≤θq therefore allows the effect of reducing flow separation to be greater than the effect of reducing the flow rate, and input power to the centrifugal fan 1 is thus reduced. The efficiency of the centrifugal fan 1 is thus improved.

Embodiment 12

The centrifugal fan 1 can be included not only in the heat source unit 40 of the air-conditioning apparatus described in Embodiment 1 but also in other units and apparatuses. In Embodiment 12, an air-conditioning-apparatus indoor unit 53 including the centrifugal fan 1 is described as an example.

Figure 12:
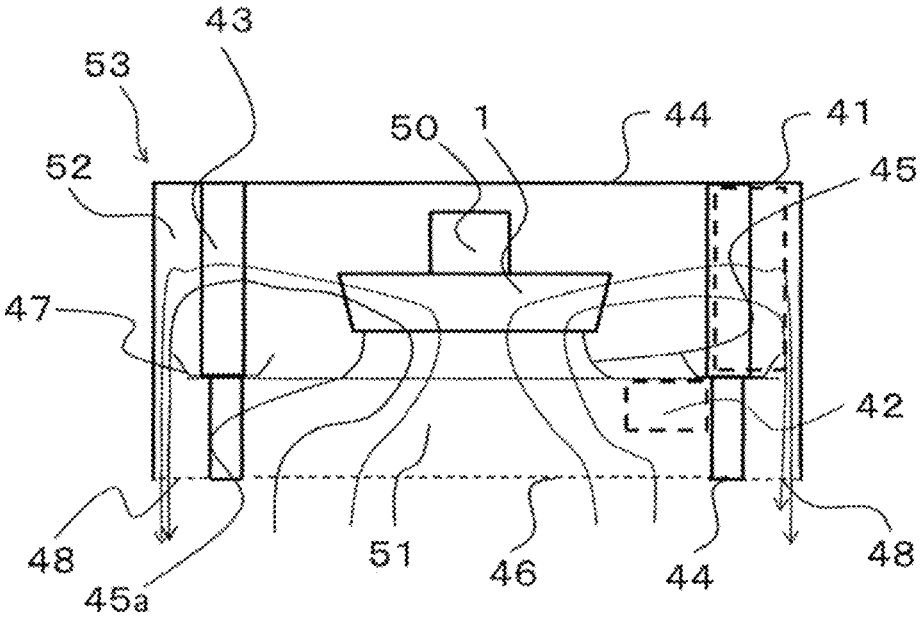
FIG. 12 is a sectional view illustrating the structure of an air-conditioning-apparatus indoor unit including the centrifugal fan.

FIG. 12 is a sectional view illustrating the structure of the air-conditioning-apparatus indoor unit 53 including the centrifugal fan 1. As illustrated in FIG. 12, the indoor unit 53 includes at least one heat exchanger 43, a compressor 41, a control box 42, the centrifugal fan 1, a bell mouth 45, a fan motor 50, and a drain pan 47. The heat exchanger 43, the compressor 41, the control box 42, the centrifugal fan 1, the bell mouth 45, the fan motor 50, and the drain pan 47 are arranged in a casing 44, which is the shell of the indoor unit 53.

The casing 44 has an air inlet 46 and an air outlet 48. The air inlet 46 and the air outlet 48 are opened to provide communication between the inside and the outside of the casing 44. The air outlet 48 is opened in, for example, the same surface of the casing 44 as that in which the air inlet 46 is opened. In other words, the indoor unit 53 suctions air and blows air through a lower surface or an upper surface of the casing 44. The air is suctioned into and blown out of the casing 44 through the same surface of the casing 44. With reference to FIG. 12, the air inlet 46 is opened at a central portion of the lower surface of the casing 44 and the air outlet 48 is opened around the air inlet 46 in Embodiment 12.

The heat exchanger 43 is disposed between the centrifugal fan 1 and the air outlet 48 and is disposed downstream of the centrifugal fan 1. The centrifugal fan 1 has the rotation axis X and rotates about the rotation axis X to send a fluid. The centrifugal fan 1 is driven to rotate by the fan motor 50. The bell mouth 45 is disposed at part of the centrifugal fan 1 through which a fluid is suctioned and guides the fluid flowing through an air inlet passage 51 to the centrifugal fan 1. The bell mouth 45 includes a portion having an opening that gradually decreases in diameter in a direction from its inlet adjacent to the air inlet passage 51 toward the centrifugal fan 1. The drain pan 47 is disposed under the heat exchanger 43.

The casing 44 has the air inlet passage 51 and an air outlet passage 52, which are divided by a partition, in the casing 44. The air inlet passage 51 is located in lower part of the casing 44 and communicates with the air inlet 46 to guide the air suctioned through the air inlet 46 to the bell mouth 45. The air outlet passage 52 is located in upper part of the casing 44 and communicates with the air outlet 48 to guide the fluid blown out of the centrifugal fan 1 to the air outlet 48.

As described above, as the air-conditioning-apparatus indoor unit 53 includes the centrifugal fan 1, the air-conditioning-apparatus indoor unit 53 achieves improved fan efficiency to improve operation efficiency.

REFERENCE SIGNS LIST centrifugal fan 2 main plate 3 hub 3*a* hole 4 blade 4*a* suction surface 4*b* pressure surface 4*c* main-plate-side end 4*d* shroud-side end 4*e* cutting-plane line 5 shroud 5*a* shroud inner surface 5*b* shroud outer surface 5*c* protrusion 5*d* outer circumferential face 6 leading edge 6*a* connection part 6*b* recess 6*c* projection 6*d* tip 8 trailing edge 40 heat source unit 41 compressor 42 control box 43 heat exchanger 44 casing 45 bell mouth 45*a* end 46 air inlet 47 drain pan 48 air outlet air passage partition 50 fan motor 51 air inlet passage 52 air outlet passage 53 indoor unit 80 circulating flow L1 tangent L2 tangent L3 reference line L6 tangent L7 straight line L8 tangent 0 center X rotation axis θb angle θh angle θq angle θs angle

The invention claimed is:

1. A centrifugal fan comprising:

a main plate;

a blade connected to the main plate; and a shroud having an annular shape and connected to a shroud-side end of the blade that is an end opposite a main-plate-side end of the blade connected to the main plate, the centrifugal fan being configured to rotate about a rotation axis to suction a fluid through an opening of the shroud and discharge the fluid through the blade in a radial direction, the blade having a leading edge that is an edge of the blade located forward in a rotation direction, and a trailing edge that is an edge opposite the leading edge and is located farther from the rotation axis than the leading edge, a length of the blade from the leading edge to the trailing edge in a section parallel to the main plate being a circumferential length, a distance between a peripheral edge of the main plate and a peripheral edge of the shroud being an outlet height, part of the blade that has a longest circumferential length being located closer to the shroud than a middle of the outlet height, the leading edge including a recess located next to a point P4 at which a shroud inner surface of the shroud that faces the main plate is connected to the leading edge, the recess including a connection part extending from the point P4 toward the trailing edge and defining a valley shape having a bottom when the recess is viewed from the rotation axis, and a projection located closer to the main plate than the recess, the projection projecting in the rotation direction and having an inverted-V shape with a peak when the projection is viewed from the rotation axis, the outlet height being 2h, a point that is one of opposite ends of the projection and is located close to the main plate being point P1_1, a second point of the opposite ends and that is located close to the shroud being point P3_1, a distance f1_1 between the point P1_1 and the main plate set to satisfy 0.05×2h f1_1 0.2×2h, a distance f3_1 between the point P3_1 and the main plate set to satisfy 0.8 ×2h≤f3_1≤1.3 ≤2h.

2. The centrifugal fan of claim 1, wherein a tangent L1 to the shroud inner surface at the point P4 and a tangent L2 to the leading edge at the point P4 form an angle of 90 degrees or less.

3. The centrifugal fan of claim 2, wherein an angle θs formed by the tangent and a straight line L5 parallel to the rotation axis and an angle θb formed by the tangent L1 and the tangent L2 to the leading edge at the point P4 are set to satisfy 0 degrees <θb<θs.

4. The centrifugal fan of claim 3, wherein the angle θs and the angle Oh are set to satisfy 0 degrees ≤θh <θs/2.

5. The centrifugal fan of claim 3, wherein the angle θs is set o satisfy 0 degrees ≤θs <60 degrees.

6. The centrifugal fan of claim 1, wherein a point on the leading edge of the part of the blade having the longest circumferential length is point P2_1, and a change in circumferential length between the points P2_1 and P3_1 with respect to a change in distance in a direction along the rotation axis is greater than a change in circumferential length between the points P1_1 and P2_1 with respect to a change in distance in the direction along the rotation axis.

7. The centrifugal fan of claim 1, wherein the projection is smoothly continuous with the recess.

8. The centrifugal fan of claim 7, wherein the leading edge has a shape including a sinusoidal shape corresponding to at least half a cycle of a sine curve when the leading edge is projected in the radial direction.

9. The centrifugal fan of claim 1, wherein a point at which the shroud inner surface is connected to a suction surface of the blade that faces the rotation axis in a section containing the rotation axis is a point Q, an angle formed at the point Q between a tangent L6 to the shroud inner surface and a line parallel to the rotation axis is an angle θq, an angle formed between the tangent L6 and a tangent L8 to the suction surface at the point Q is an angle θh, and the angle θh is set to satisfy 0 degrees ≤θh<θq.

10. An air-conditioning apparatus comprising a heat source unit and a load-side unit, at least one of the heat source unit and the load-side unit including the centrifugal fan of claim 1.

11. The air-conditioning apparatus of claim 10, wherein the heat source unit includes a heat exchanger and the centrifugal fan in a casing, wherein the casing includes a panel removable from a side face of the casing, and wherein the side face with the panel removed is used as an air inlet or an air outlet of the heat source unit.

* * * * *